US010787854B2

(12) United States Patent
Tsuboi et al.

(10) Patent No.: US 10,787,854 B2
(45) Date of Patent: Sep. 29, 2020

(54) VEHICULAR OPENING/CLOSING BODY CONTROL DEVICE AND VEHICULAR OPENING/CLOSING BODY CONTROL METHOD

(71) Applicant: AISIN SEIKI KABUSHIKI KAISHA, Kariya-shi (JP)

(72) Inventors: Tomoya Tsuboi, Nagoya (JP); Ryo Asano, Kariya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 81 days.

(21) Appl. No.: 16/242,104

(22) Filed: Jan. 8, 2019

(65) Prior Publication Data

US 2019/0226262 A1 Jul. 25, 2019

(30) Foreign Application Priority Data

Jan. 23, 2018 (JP) ..... 2018-008865

(51) Int. Cl.
*E05F 15/40* (2015.01)
*E05F 15/616* (2015.01)
*E05F 15/70* (2015.01)

(52) U.S. Cl.
CPC ..... *E05F 15/40* (2015.01); *E05F 15/616* (2015.01); *E05F 15/70* (2015.01); *E05Y 2201/21* (2013.01); *E05Y 2201/23* (2013.01); *E05Y 2201/434* (2013.01); *E05Y 2400/302* (2013.01); *E05Y 2400/36* (2013.01); *E05Y 2900/532* (2013.01)

(58) Field of Classification Search
CPC ..... E05F 15/40; E05F 15/616; E05F 15/70; E05Y 2201/21; E05Y 2201/23; E05Y 2400/302; E05Y 2400/36; E05Y 2900/532
See application file for complete search history.

(56) References Cited

U.S. PATENT DOCUMENTS

| | | | | |
|---|---|---|---|---|
| 9,080,366 | B2 * | 7/2015 | Schiegel | E05F 15/622 |
| 9,376,850 | B2 * | 6/2016 | Suzuki | B60J 5/101 |
| 10,151,132 | B2 * | 12/2018 | Elie | E05F 15/60 |
| 10,443,287 | B2 * | 10/2019 | Elie | G01D 5/34 |
| 10,443,289 | B2 * | 10/2019 | Rrumbullaku | E05F 15/71 |
| 2008/0150319 | A1 * | 6/2008 | Ray | E05F 15/70 296/146.1 |
| 2016/0177609 | A1 * | 6/2016 | Nishikibe | E05F 1/002 49/31 |
| 2017/0030127 | A1 * | 2/2017 | Elie | E05F 15/77 |

(Continued)

FOREIGN PATENT DOCUMENTS

JP 2017-172179 9/2017

*Primary Examiner* — Lori L Lyjak
(74) *Attorney, Agent, or Firm* — Oblon, McClelland, Maier & Neustadt, L.L.P.

(57) ABSTRACT

A vehicular opening/closing body control device includes: an opening drive control unit configured to control operation of a drive device configured to drive a vehicular opening/closing body to open the opening/closing body upward; a gravity descent detection unit configured to detect a descent of the opening/closing body opened upward due to gravity, a braking force imparting unit configured to impart a braking force to the opening/closing body whose descent due to gravity is detected; and an opening drive prohibition unit configured to prohibit opening drive by the drive device of the opening/closing body whose descent due to gravity is detected.

12 Claims, 3 Drawing Sheets

(56) References Cited

U.S. PATENT DOCUMENTS

| | | | | |
|---|---|---|---|---|
| 2017/0044815 | A1* | 2/2017 | Watanabe | E05B 81/36 |
| 2017/0070167 | A1* | 3/2017 | Nagler | E05F 15/611 |
| 2019/0169914 | A1* | 6/2019 | Conner | E05F 15/70 |

* cited by examiner

VEHICULAR OPENING/CLOSING BODY CONTROL DEVICE AND VEHICULAR OPENING/CLOSING BODY CONTROL METHOD

CROSS REFERENCE TO RELATED APPLICATIONS

This application is based on and claims priority under 35 U.S.C. § 119 to Japanese Patent Application 2018-008865, filed on Jan. 23, 2018, the entire contents of which are incorporated herein by reference.

TECHNICAL FIELD

This disclosure relates to a vehicular opening/closing body control device and a vehicular opening/closing body control method.

BACKGROUND DISCUSSION

In the related art, a vehicular opening/closing body such as a so-called flip-up type back door is opened by being moved upward. In addition, an opening/closing body control device is capable of opening such an opening/closing body using a motor or the like as a driving source. Further, for example, in the opening/closing body control device disclosed in JP 2017-172179 A (Reference 1), a state in which the opening and closing body (back door), which is opened upward, descends (falls) due to gravity is detected by detecting power generated by a motor serving as a driving source, that is, electromotive voltage generated when the motor is brought to a regenerative state. When a failure in opening operation of such an opening/closing body is detected, the operation of the motor is controlled to apply a braking force to the opening/closing body such that the opening/closing body does not fall sharply.

In the example of the related art, a control unit of the motor, which is the driving source thereof, shifts to a sleep state when the opening/closing body is stopped. Furthermore, when a descent of the opening/closing body due to gravity is detected as described above, the control unit is activated from the slip state and executes the braking control of the opening/closing body. As a result of this, the power consumption is reduced.

However, with the above-described configuration of the related art, due to the execution of the braking control, even after the above-mentioned failure in opening operation has occurred, there is a possibility that the user continues to use the opening/closing body without particularly feeling inconvenience. Due to this, for example, there is a fear that a factor causing the descent due to gravity, such as a failure of a support device, is left unattended, leaving room for improvement in this respect.

Thus, a need exists for a vehicular opening/closing body control device and a vehicular opening/closing body control method which are not susceptible to the drawback mentioned above.

SUMMARY

A vehicular opening/closing body control device according to an aspect of this disclosure includes an opening drive control unit configured to control operation of a drive device configured to drive a vehicular opening/closing body to open the opening/closing body upward, a gravity descent detection unit configured to detect a descent of the opening/closing body opened upward due to gravity, a braking force imparting unit configured to impart a braking force to the opening/closing body whose descent due to gravity is detected, and an opening drive prohibition unit configured to prohibit opening drive by the drive device of the opening/closing body whose descent due to gravity is detected.

A vehicular opening/closing body control method according to an aspect of this disclosure includes performing opening drive of a vehicular opening/closing body to open the opening/closing body, detecting a descent of the opening/closing body opened upward due to gravity, imparting a braking force to the opening/closing body whose descent due to gravity is detected, and prohibiting the opening drive of the opening/closing body whose descent due to gravity is detected.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment in which a vehicular opening/closing body control device is implemented as a power back door device will be described with reference to the drawings.

Figure 1:
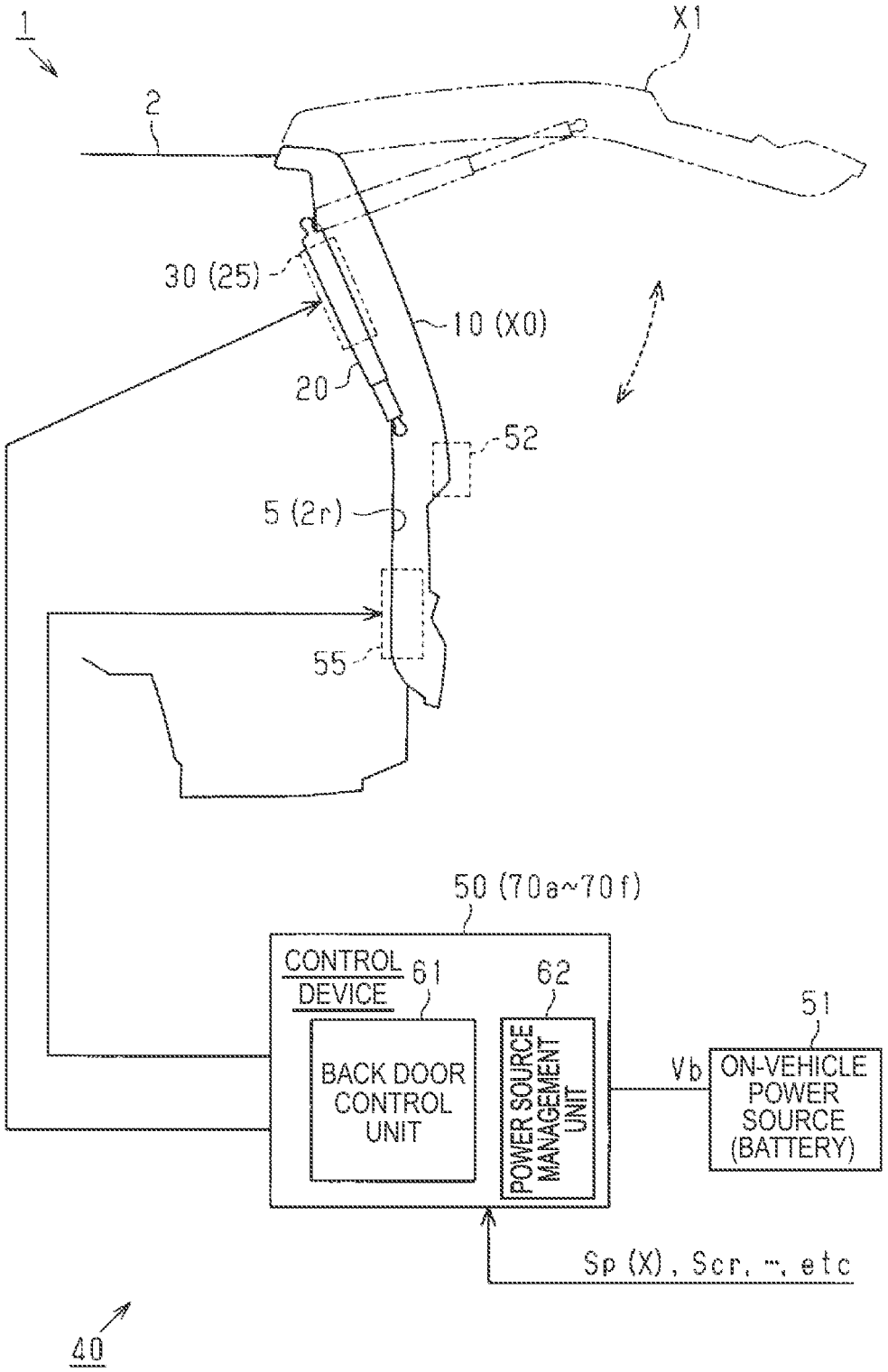
FIG. 1 is a schematic configuration view of a power back door device.

As illustrated in FIG. 1, in a vehicle 1 of the present embodiment, a so-called flip-up back door 10 is provided in a door opening portion 5 formed in the rear end portion 2*r* of a vehicle body 2. That is, the back door 10 is opened upward (rotates counterclockwise in FIG. 1) using the upper end portion of the door opening 5 as a pivot point. In addition, a pair of support devices (e.g., dampers) 20 are provided at opposite end portions in the width direction of the door opening portion 5, in which each of the support devices has an expandable shaft shape and axial ends thereof are connected to be pivotable with respect to the vehicle body 2 side and the back door 10 side. In the vehicle 1 of the present embodiment, each of the support devices 20 supports the back door 10 such that the operation position (e.g., in FIG. 1, a fully opened position X1 indicated by a two-dot chain line) of the back door 10, which has opened upward from the fully closed position X0 is held.

In addition, the vehicle 1 of the present embodiment is provided with a drive device 30 that drives the back door 10 as an opening/closing body thereof using a motor 25 as a driving source. Specifically, a drive device 30 is provided integrally with each of the support devices 20. That is, the drive device 30 converts the rotation of the motor 25 into an expansion/contraction operation of the support device 20. The vehicle 1 of the present embodiment is provided with a power back door device 40 capable of opening and closing the back door 10 based on the driving force of the motor 25. In addition, the drive device 30 may be provided separately from each support device 20.

More specifically, the operation of the drive device 30 of the present embodiment is controlled by a control device 50. Specifically, the control device 50 of the present embodiment controls the rotation of the motor 25 by supplying driving power based on the power supply voltage Vb of an on-vehicle power supply 51 to the drive device 30. Further, the drive device 30 of the present embodiment outputs a pulse signal Sp synchronized with the rotation of the motor 25. Then, the control device 50 is configured to detect the operation position X of the back door 10 by counting the pulse signal Sp (the pulse edges thereof).

In addition, the control device 50 is input with an operation input signal Scr indicating that an operation input unit 52 provided in the back door 10, a portable device (not illustrated), or the like is operated. In the vehicle 1 of the present embodiment, for example, a non-contact sensor such as a capacitance sensor is used as the operation input unit 52. The control device 50 of the present embodiment is configured to control the operation of the drive device 30 so as to open and close the back door 10 based on the operation request indicated by the operation input signal Scr.

Specifically, in the case where the back door 10 is in the fully closed position X0, when the operation input unit 52 provided in the back door 10 is operated, the control device 50 of the present embodiment opens the back door 10 to the fully opened position X1 by driving the back door 10 upward. At this time, the control device 50 opens a door lock device 55 (unlocks a door lock) provided in the back door 10 on the condition that a predetermined cancellation condition is satisfied, such as when a regular portable device (a user possessing the regular portable device) is present within an authentication region set in the vicinity of the back door 10. In the case where the back door 10 is in the state of being opened, when the operation input unit 52 provided in the back door 10 is operated, the control device 50 of the present embodiment is configured to close the back door 10 to the fully closed position X0.

More specifically, as described above, the control device 50 of the present embodiment includes a back door control unit 61 that executes operation control of the drive device 30 and the door lock device 55, and a power source management unit 62 that manages power supply to the back door control unit 61. In the control device 50 of the present embodiment, the power source management unit 62 executes power supply to the back door control unit 61 when it becomes necessary to control the operation of the back door 10. Further, when the operation control of the back door 10 is completed, the power source management unit 62 stops the power supply to the back door control unit 61. Thus, the control device 50 of the present embodiment is configured to reduce the power consumption of the back door control unit 61 by shifting the back door control unit 61 to the sleep state.

Figure 2:
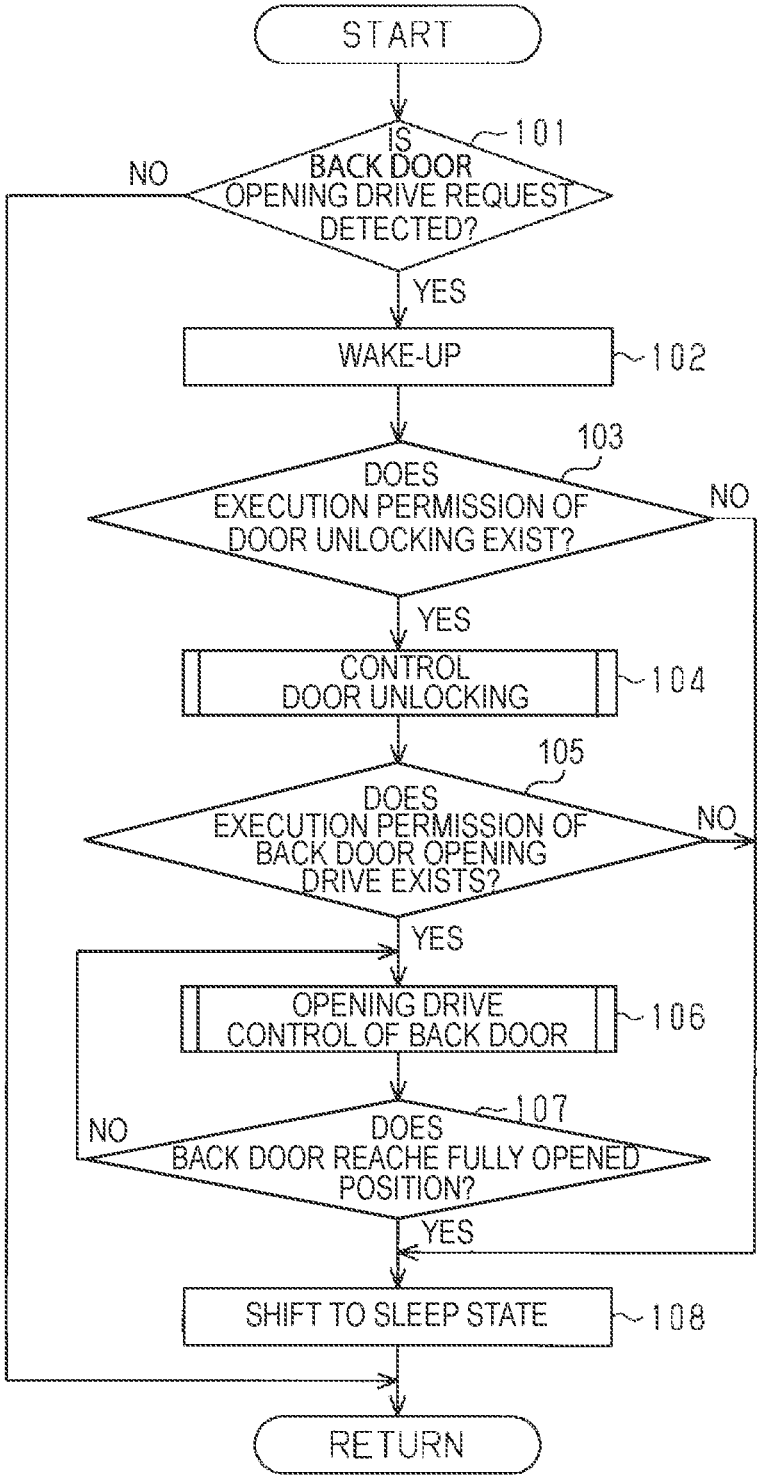
FIG. 2 is a flowchart illustrating a mode of back door control based on an opening drive request.

That is, as illustrated in the flowchart of FIG. 2, for example, when the back door 10 is in the fully closed position X0, the control device 50 of the present embodiment detects the opening operation request of the back door 10 based on the operation input signal Scr (Step 101: YES), and the power source management unit 62 starts power supply to the back door control unit 61. As a result, when the back door control unit 61 is activated from the sleep state, the back door 10 is in the state where the opening drive control of the back door 10 is capable of being executed (wake-up) (step 102).

Next, the control device 50 of the present embodiment determines whether or not execution permission of door lock release exists (step 103), and when it is determined that the execution permission exists (step 103: YES), the control device 50 controls the operation of the door lock device 55 provided in the back door 10 to release the door lock (door lock release control) (step 104). Further, the control device 50 determines whether or not execution permission of opening drive by the drive device 30 exists with respect to the back door 10 (step 105). When it is determined that the execution permission exists (step 105: YES), the operation of the drive device 30 is controlled to execute the opening drive of the back door 10 (back door opening drive control) (step 106).

In this case, the control device 50 of the present embodiment executes the back door opening drive control of step 106 until the operation position X of the back door 10 reaches the fully opened position X1 as described above (step 107: NO). Furthermore, when the back door 10 reaches the fully opened position X1 (step 107: YES), the control device 50 terminates the back door opening drive control, whereby the power source management unit 62 stops power supply to the back door control unit 61. Thus, the control device 50 of the present embodiment is configured to cause the back door control unit 61 to shift again to the sleep state (step 108).

When the execution permission of the opening drive by the drive device 30 does not exist in the step 105 (step 105: NO), the control device 50 does not execute the processing of the above-mentioned steps 106 and 107. When it is determined in step 103 that permission execution of door lock release does not exist (step 103: NO), the control device 50 does not execute the processing of steps 104 to 107.

In addition, the control device 50 of the present embodiment has a function of detecting occurrence of an opening failure in which the back door 10, which has been opened upward as described above, descends due to gravity due to the failure of the support device 20 or the like. Specifically, after completion of the opening drive control, the control device 50 monitors a change in the pulse signal Sp output by the drive device 30 while keeping the back door control portion 61 in the sleep state. When detecting the descent due to gravity of the back door 10, the control device 50 of the present embodiment starts power supply to the back door control unit 61 by the power source management unit 62. The back door control unit 61 activated from the sleep state thereby controls the operation of the drive device 30, thereby imparting a braking force to the back door 10. Thus, the power back door device 40 of the present embodiment is configured so that the back door 10 does not fall sharply even when a failure occurs in the support device 20.

Figure 3:
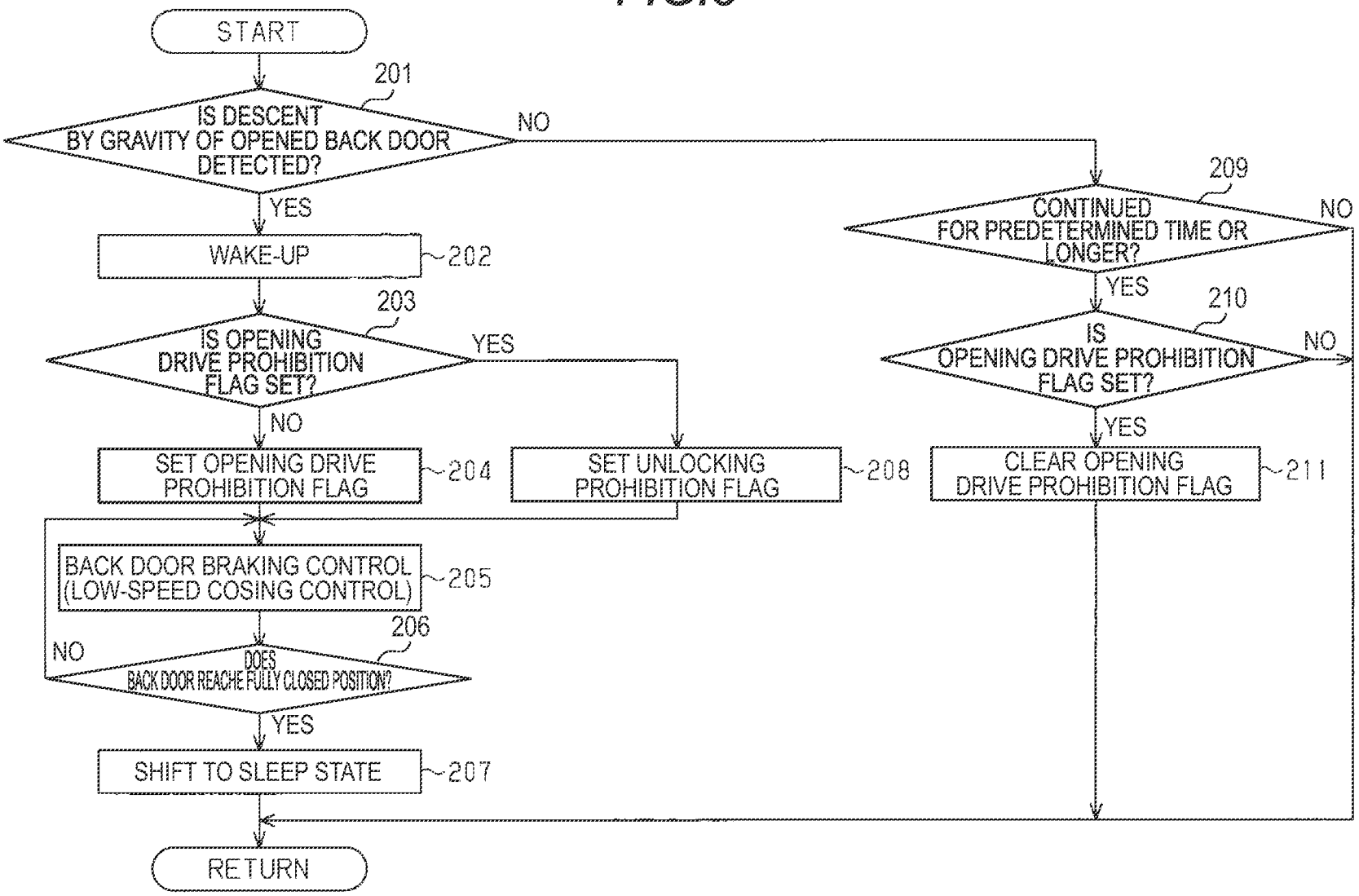
FIG. 3 is a flowchart illustrating a mode of back door opening drive prohibition control based on detection of a descent due to gravity.

More specifically, as illustrated in the flowchart of FIG. 3, the control device 50 of the present embodiment detects the state in which the back door 10, which has opened upward, descends due to gravity (step 201: YES), whereby the back door control unit 61 is activated from the sleep state (wake-up) (step 202). At this time, the control device 50 determines whether or not an opening drive prohibition flag that prohibits opening drive by the drive device 30 is set for the back door 10 (step 203). When it is determined that the opening drive prohibition flag is not set (step 203: NO), the control device 50 sets an opening drive prohibition flag (step 204), and executes the braking control of the back door 10, which descends due to gravity (step 205).

Specifically, as the braking control of the back door 10, the control device 50 of the present embodiment executes control to suppress the rotation of the motor 25 in synchronization with the descent of the back door 10. Consequently, the control device 50 is configured to cause the back door 10 to perform closing operation while suppressing a speed of the descent due to gravity of the back door 10 by imparting a braking force to the back door 10 (low speed closing operation control).

In this case, the control device 50 of the present embodiment executes the back door opening drive control of step 205 until the operation position X of the back door 10 reaches the fully closed position X0 (step 206: NO). Furthermore, when the back door 10 reaches the fully closed position X0 (step 206: YES), the control device 50 terminates the back door braking drive control, whereby the power source management unit 62 stops power supply to the back door control unit 61. Thus, the control device 50 is configured to cause the back door control unit 61 to shift to the sleep state again (step 207).

Meanwhile, when it is determined in step 203 that the opening drive prohibition flag has already been set (step 203: YES), the control device 50 sets a lock release prohibition flag indicating that the door lock release is prohibited with respect to the back door 10 (step 208). Then, similarly to the case where the opening drive prohibition flag is set in step 204, the control device 50 imparts a braking force to the back door 10 that descends due to gravity by executing the processing of step 205 and steps following step 205.

That is, since the opening drive prohibition flag is set in step 204, with respect to the opening drive of the back door 10 by the drive device 30 (see FIG. 2, step 106), it is determined that execution permission does not exist (step 105: NO). In addition, the power back door device 40 of the present embodiment has a configuration in which, when the descent due to gravity of the back door 10 is detected consequently even if, for example, the operation input unit 52 provided in the back door 10 is operated thereafter, it is unable to perform opening drive of the back door 10 using the drive device 30.

In the power back door device 40 of the present embodiment is configure such that even when the opening drive of the back door 10 by the drive device 30 is prohibited, the back door 10 can be opened manually. However, even in this case, as the lock release prohibition flag is set in step 208, it is determined with respect to the back door 10 that execution permission of the door lock release (see FIG. 2, step 104) does not exist (step 103: NO in the same drawing).

That is, the power back door device 40 of the present embodiment is configured such that even when the back door 10 is in the fully closed state after the descent due to gravity of the back door 10, which has been opened by being driven by the drive device 30, is detected, it is possible to perform door unlocking once and to manually open the back door 10. In the case where a descent due to gravity is detected again in the back door 10, which has been manually opened, thereafter, by preventing unlocking after the back door 10 moves to the fully closed position X0, the fully closed state of the back door 10 is maintained. That is, the power back door device 40 has a configuration in which until the cause of the descent due to gravity of the back door 10 is eliminated, for example, until the failure of the support device 20 is repaired, the back door 10 does not open.

When the descent due to gravity of the opened back door 10 is not detected for a predetermined time or longer (step 201: NO and step 209: YES), the control device 50 of the present embodiment determines whether or not an opening drive prohibition flag is set for the back door 10 (step 210). Then, when it is determined that the opening drive prohibition flag is set (step 210: YES), the control device 50 is configured to clear the opening drive prohibition flag (step 211).

In other words, when the back door 10, for which the opening driving by the drive device 30 is prohibited, is in the opened state, it is presumed that the back door 10 is manually opened. Furthermore, when a descent due to gravity is not detected for the back door 10, the control device 50 of the present embodiment regards that the cause of the descent due to gravity has been eliminated. Consequently, the power back door device 40 of the present embodiment is configured to return to a state where the opening drive of the back door 10 is capable of being performed by the drive device 30.

In addition to the case where the descent due to gravity of the opened back door 10 is not detected for a predetermined period of time or longer, a canceling means based on a special operation, such as clearing the set opening drive prohibition flag by the control device 50 by detecting a release signal through communication with an external device, may be set. This makes it possible to enhance convenience, for example, when a failure is repaired at a repair shop.

Next, effects of the present embodiment will be described.

(1) The control device 50 as an opening drive control unit 70*a* controls the operation of the drive device 30 to open the back door 10 constituting an opening/closing body of the vehicle 1 upward. In addition, the control device 50 as a gravity descent detection unit 70*b* detects that the upwardly opened back door 10 is in a state of descending due to gravity (step 201: YES). Further, the control device 50 as a braking force imparting 70*c* imparts a braking force to the back door 10 for which a descent due to gravity is detected (step 205). Furthermore, the control device 50 as an opening drive prohibition unit 70*d* prohibits the opening drive by the drive device 30 with respect to the back door 10, for which the descent due to gravity is detected (step 204).

According to the above-described configuration, even when the back door 10 is in the state of descending due to gravity, such as a failure of the support device 20, it is possible to prevent the back door 10 from falling sharply, thereby ensuring high safety. Further, thereafter, it is unable to open the back door 10 by the drive device 30. Consequently, by informing the user of the opening failure occurring in the back door 10, it is possible to urge the user to repair the back door 10.

(2) When a descent due to gravity is not detected for the back door 10 for which opening drive by the drive device 30 is prohibited (step 201: NO, step 209: YES, and step 210: YES), the control device 50 as a drive prohibition canceling unit 70*e* cancels the prohibition of the opening drive set for the back door 10 (step 211).

That is, even when a descent due to gravity of the back door 10 has been detected, it may be regarded that the cause of occurrence of the opening failure, which occurred at the previous opening drive, is eliminated when a descent due to gravity is not detected when the back door 10 is manually opened upward next time. Consequently, it is possible to open the back door 10 again using the drive device 30, whereby it is possible to improve convenience.

(3) When a descent due to gravity is detected again with respect to the back door 10 for which opening drive by the drive device 30 is prohibited (step 201: YES, and step 203: YES), the control device 50 as a drive prohibition canceling unit 70*e* prohibits the door unlocking for the back door 10 (step 208).

According to the above-described configuration, it is no longer possible to open the back door 10 held at the fully closed position X0. Consequently, it is possible to ensure high safety and to more effectively urge the user to repair an opening failure caused in the back door 10.

(4) The control device 50 controls the drive device 30 to impart a braking force to the back door 10, thereby moving the back door 10 to the fully closed position X0 while suppressing a speed of the descent due to gravity. Consequently, it is possible to ensure high safety by preventing occurrence of so-called pinching.

(5) The control device 50 includes a back door control unit 61 as an opening/closing body control unit functioning as an opening drive control unit 70*a* and a braking force imparting unit 70*c* for the drive device 30 by controlling the operation of the drive device 30, and a power source management unit 62 that manages power supply to the control unit 61. When the opening drive of the back door 10 by the drive device 30 is completed, the power source management unit 62 stops the power supply to the back door control unit 61, and shifts the back door control unit 61 to the sleep state. Then, the power source management unit 62 activates the back door control unit 61 from the sleep state by detecting a descent due to gravity of the back door 10. Consequently, it is possible to reduce power consumption.

The above-described embodiment may be implemented with the following modifications. The above-described embodiment and the following modifications can be implemented in combination with each other to the extent that they do not conflict technically.

In the above-described embodiment, the present disclosure is implemented as a power back door device 40 that opens and closes a back door 10 as an opening/closing body provided in the rear end portion 2*r* of a vehicle body 2. However, the present disclosure is not limited to this and is applicable to any opening and closing body such as a so-called gull wing type side door or a trunk lid, as long as the opening and closing body of the vehicle 1 as an object to be controlled is opened upward.

In the above-described embodiment, when a descent by gravity of the back door 10 is detected, the drive device 30 is controlled to impart a braking force to the back door 10, thereby moving the back door 10 to the fully closed position X0 while suppressing descent speed due to gravity. However, the present disclosure is not limited to this, and a configuration may be adopted in which the operation position X of the opened back door 10 is held by imparting the braking force. Further, as long as the braking force is substantially imparted, for example, a configuration may be adopted in which the low-speed closing drive control of the back door 10 is performed. Further, the operation position X for holding the back door 10 is not necessarily the fully opened position X1. A configuration may be adopted in which a braking force may be imparted to the back door 10 by controlling the operation of a brake device provided separately from the drive device 30.

In the above-described embodiment, a descent by gravity of the back door 10 is detected by monitoring the change of a pulse signal Sp synchronized with the rotation of the motor 25, which is the drive source of the drive device 30. However, without being limited to this, the method of detecting the descent due to gravity of the back door 10 may be arbitrarily changed. For example, an electromotive force (power generation state) generated when the motor 25 is turned into a regenerative state may be monitored.

In the above-described embodiment, the power consumption of the control device 50 is reduced by executing the sleep control of the back door control unit 61. However, this may be implemented with a configuration in which such sleep control is not performed.

In the above-described embodiment, the drive device 30 is configured to be capable of opening and closing the back door 10, but it may be applied to a configuration in which only opening drive is performed.

A vehicular opening/closing body control device according to an aspect of this disclosure includes an opening drive control unit configured to control operation of a drive device configured to drive a vehicular opening/closing body to open the opening/closing body upward, a gravity descent detection unit configured to detect a descent of the opening/closing body opened upward due to gravity, a braking force imparting unit configured to impart a braking force to the opening/closing body whose descent due to gravity is detected, and an opening drive prohibition unit configured to prohibit opening drive by the drive device of the opening/closing body whose descent due to gravity is detected.

According to the above-described configuration, even when the opening/closing body is in the state of descending due to gravity, such as a failure of a support device, it is possible to prevent the opening/closing body from falling sharply, thereby ensuring high safety. Thereafter, the opening/closing body becomes unable to be opened by the drive device. Consequently, by informing the user of the opening failure occurring in the opening/closing body, it is possible to urge the user to repair the opening/closing body.

It is preferable that the vehicle opening/closing body control device according to the aspect of this disclosure further includes a drive prohibition canceling unit configured to cancel the prohibition of the opening drive when the descent due to gravity is not detected with respect to the opening/closing body for which the opening drive is prohibited.

That is, even when a descent due to gravity of the opening/closing body has been detected, it may be regarded that the cause of occurrence of the opening failure, which occurred at the previous opening drive, is eliminated when a descent due to gravity is not detected when the opening/closing body is manually opened upward next time. Consequently, it is possible to open the opening/closing body again using the drive device, whereby it is possible to improve convenience.

It is preferable that the vehicular opening/closing body control device according to the aspect of this disclosure further includes an unlocking prohibition unit configured to prohibit unlocking of the opening/closing body and hold the opening/closing body at a fully closed position when the descent due to gravity is detected with respect to the opening/closing body for which the opening drive is prohibited.

According to the above-described configuration, it is no longer possible to open the opening/closing body held at the fully closed position. Consequently, it is possible to ensure high safety and to more effectively urge the user to repair an opening failure caused in the opening/closing body.

In the vehicle opening/closing body control device according to the aspect of this disclosure, it is preferable that the braking force imparting unit moves the opening/closing body to the fully closed position while suppressing a speed of the descent due to gravity by imparting the braking force to the opening/closing body.

According to the above-described configuration, it is possible to ensure high safety by preventing occurrence of so-called pinching.

It is preferable that the vehicular opening/closing body control device according to the aspect of this disclosure further includes an opening/closing body control unit configured to function as the opening drive control unit and the braking force imparting unit by controlling the operation of the drive device, and a power source management unit configured to manage power supply to the opening/closing body control unit, in which, when the opening drive is completed, the power source management unit stops the power supply to the opening/closing body control unit and shifts the opening/closing body control unit to a sleep state, and when the descent due to gravity of the opening/closing body is detected, the power source management unit initiates power supply to the opening/closing body control device and activates the opening/closing body control unit from the sleep state.

With the above-described configuration, it is possible to reduce power consumption.

A vehicular opening/closing body control method according to an aspect of this disclosure includes performing opening drive of a vehicular opening/closing body to open the opening/closing body, detecting a descent of the opening/closing body opened upward due to gravity, imparting a braking force to the opening/closing body whose descent due to gravity is detected, and prohibiting the opening drive of the opening/closing body whose descent due to gravity is detected.

According to the aspects of this disclosure, it is possible to ensure high safety by suppressing a descent due to gravity of the opening/closing body, and urge the user to repair an opening failure caused in the opening/closing body.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicular opening/closing body control device comprising:

an opening drive control unit configured to control operation of a drive device configured to drive a vehicular opening/closing body to open the opening/closing body upward;

a gravity descent detection unit configured to detect a descent of the opening/closing body opened upward due to gravity, a braking force imparting unit configured to impart a braking force to the opening/closing body whose descent due to gravity is detected; and an opening drive prohibition unit configured to prohibit opening drive by the drive device of the opening/closing body whose descent due to gravity is detected.

2. The vehicular opening/closing body control device according to claim 1, further comprising:

a drive prohibition canceling unit configured to cancel the prohibition of the opening drive when the descent due to gravity is not detected with respect to the opening/closing body for which the opening drive is prohibited.

3. The vehicular opening/closing body control device according to claim 1, further comprising:

an unlocking prohibition unit configured to prohibit unlocking of the opening/closing body and hold the opening/closing body at a fully closed position when the descent due to gravity is detected with respect to the opening/closing body for which the opening drive is prohibited.

4. The vehicular opening/closing body control device according to claim 2, further comprising:

an unlocking prohibition unit configured to prohibit unlocking of the opening/closing body and hold the opening/closing body at a fully closed position when the descent due to gravity is detected with respect to the opening/closing body for which the opening drive is prohibited.

5. The vehicular opening/closing body control device according to claim 1, wherein the braking force imparting unit moves the opening/closing body to the fully closed position while suppressing a speed of the descent due to gravity by imparting the braking force to the opening/closing body.

6. The vehicular opening/closing body control device according to claim 2, wherein the braking force imparting unit moves the opening/closing body to the fully closed position while suppressing a speed of the descent due to gravity by imparting the braking force to the opening/closing body.

7. The vehicular opening/closing body control device according to claim 3, wherein the braking force imparting unit moves the opening/closing body to the fully closed position while suppressing a speed of the descent due to gravity by imparting the braking force to the opening/closing body.

8. The vehicular opening/closing body control device according to claim 1, further comprising:

an opening/closing body control unit configured to function as the opening drive control unit and the braking force imparting unit by controlling the operation of the drive device; and a power source management unit configured to manage power supply to the opening/closing body control unit, wherein, when the opening drive is completed, the power source management unit stops the power supply to the opening/closing body control unit and shifts the opening/closing body control unit to a sleep state, and when the descent due to gravity of the opening/closing body is detected, the power source management unit initiates power supply to the opening/closing body and activates the opening/closing body control unit from the sleep state.

9. The vehicular opening/closing body control device according to claim 2, further comprising:

an opening/closing body control unit configured to function as the opening drive control unit and the braking force imparting unit by controlling the operation of the drive device; and a power source management unit configured to manage power supply to the opening/closing body control unit, wherein, when the opening drive is completed, the power source management unit stops the power supply to the opening/closing body control unit and shifts the opening/closing body control unit to a sleep state, and when the descent due to gravity of the opening/closing body is detected, the power source management unit initiates power supply to the opening/closing body and activates the opening/closing body control unit from the sleep state.

10. The vehicular opening/closing body control device according to claim 3, further comprising:

an opening/closing body control unit configured to function as the opening drive control unit and the braking force imparting unit by controlling the operation of the drive device; and a power source management unit configured to manage power supply to the opening/closing body control unit, wherein, when the opening drive is completed, the power source management unit stops the power supply to the opening/closing body control unit and shifts the opening/closing body control unit to a sleep state, and when the descent due to gravity of the opening/closing body is detected, the power source management unit initiates power supply to the opening/closing body and activates the opening/closing body control unit from the sleep state.

11. The vehicular opening/closing body control device according to claim 5, further comprising:

an opening/closing body control unit configured to function as the opening drive control unit and the braking force imparting unit by controlling the operation of the drive device; and a power source management unit configured to manage power supply to the opening/closing body control unit, wherein, when the opening drive is completed, the power source management unit stops the power supply to the opening/closing body control unit and shifts the opening/closing body control unit to a sleep state, and when the descent due to gravity of the opening/closing body is detected, the power source management unit initiates power supply to the opening/closing body and activates the opening/closing body control unit from the sleep state.

12. A vehicular opening/closing body control method comprising:

performing opening drive of a vehicular opening/closing body to open the opening/closing body;

detecting a descent of the opening/closing body opened upward due to gravity;

imparting a braking force to the opening/closing body whose descent due to gravity is detected; and prohibiting the opening drive of the opening/closing body whose descent due to gravity is detected.

* * * * *